US010226950B2

(12) United States Patent
Lutz et al.

(10) Patent No.: US 10,226,950 B2
(45) Date of Patent: Mar. 12, 2019

(54) PRINT-HEAD MODULE

(71) Applicant: PADALUMA INK-JET-SOLUTIONS GMBH & CO. KG, Markt Erlbach (DE)

(72) Inventors: Patrik Lutz, Markt Erlbach (DE); Jan-Erik Schwalme, Markt Erlbach (DE)

(73) Assignee: PadaLuma Ink-Jet-Solutions GmbH & Co. KG, Markt Erlbach (DE)

( * ) Notice: Subject to any disclaimer, the term of this patent is extended or adjusted under 35 U.S.C. 154(b) by 0 days.

(21) Appl. No.: 15/626,522

(22) Filed: Jun. 19, 2017

(65) Prior Publication Data

US 2017/0282614 A1 Oct. 5, 2017

Related U.S. Application Data

(63) Continuation of application No. PCT/EP2014/078587, filed on Dec. 18, 2014.

(51) Int. Cl.

| | |
|---|---|
| ***B41J 25/00*** | (2006.01) |
| ***B41J 2/155*** | (2006.01) |
| ***B41J 25/316*** | (2006.01) |
| ***B41J 25/34*** | (2006.01) |
| ***B41J 25/304*** | (2006.01) |

(52) U.S. Cl.

CPC ..... *B41J 25/001* (2013.01); *B41J 2/155* (2013.01); *B41J 25/304* (2013.01); *B41J 25/316* (2013.01); *B41J 25/34* (2013.01); *B41J 2202/14* (2013.01); *B41J 2202/20* (2013.01); *B41J 2202/21* (2013.01)

(58) Field of Classification Search

CPC ..... B41J 25/001; B41J 25/304; B41J 25/316; B41J 2202/14; B41J 2202/21; B41J 2202/20

See application file for complete search history.

(56) References Cited

U.S. PATENT DOCUMENTS

| | | | |
|---|---|---|---|
| 5,428,375 | A | 6/1995 | Simon et al. |
| 2011/0149003 | A1 | 6/2011 | Kondo |
| 2013/0100209 | A1 | 4/2013 | Lutz |

(Continued)

FOREIGN PATENT DOCUMENTS

| | | | |
|---|---|---|---|
| EP | 0571804 | A2 | 12/1993 |
| JP | 2001191610 | A | 7/2001 |

(Continued)

*Primary Examiner* — Geoffrey S Mruk

(74) *Attorney, Agent, or Firm* — Laurence A. Greenberg; Werner H. Stemer; Ralph E. Locher

(57) ABSTRACT

A print-head module for a single-pass inkjet printer contains a housing component with a transverse bracket which extends in the X-direction and on which a number of print heads are arranged which are adjusted positionally with respect to at least one reference position. A load-bearing frame with a supporting device is provided for supporting the load-bearing frame. The housing component is mounted on the load-bearing frame such that it swings about a pendulum axis. Furthermore, a single-pass inkjet printer has at least one print-head module of this type. The inkjet printer contains a frame construction with a support, on which the at least one print-head module is placed by use of the supporting device.

27 Claims, 4 Drawing Sheets

(56) References Cited

U.S. PATENT DOCUMENTS

| | | | | |
|---|---|---|---|---|
| 2013/0292529 | A1* | 11/2013 | Takada | B41J 25/3086 248/205.1 |
| 2016/0096365 | A1 | 4/2016 | Koga | |

FOREIGN PATENT DOCUMENTS

| | | | |
|---|---|---|---|
| JP | 2008055756 | A | 3/2008 |
| JP | 2010076165 | A | 4/2010 |
| JP | 2013163319 | A | 8/2013 |
| JP | 2013230643 | A | 11/2013 |
| JP | 2013230678 | A | 11/2013 |
| WO | 2011157281 | A1 | 12/2011 |
| WO | 2014185451 | A1 | 11/2014 |

* cited by examiner

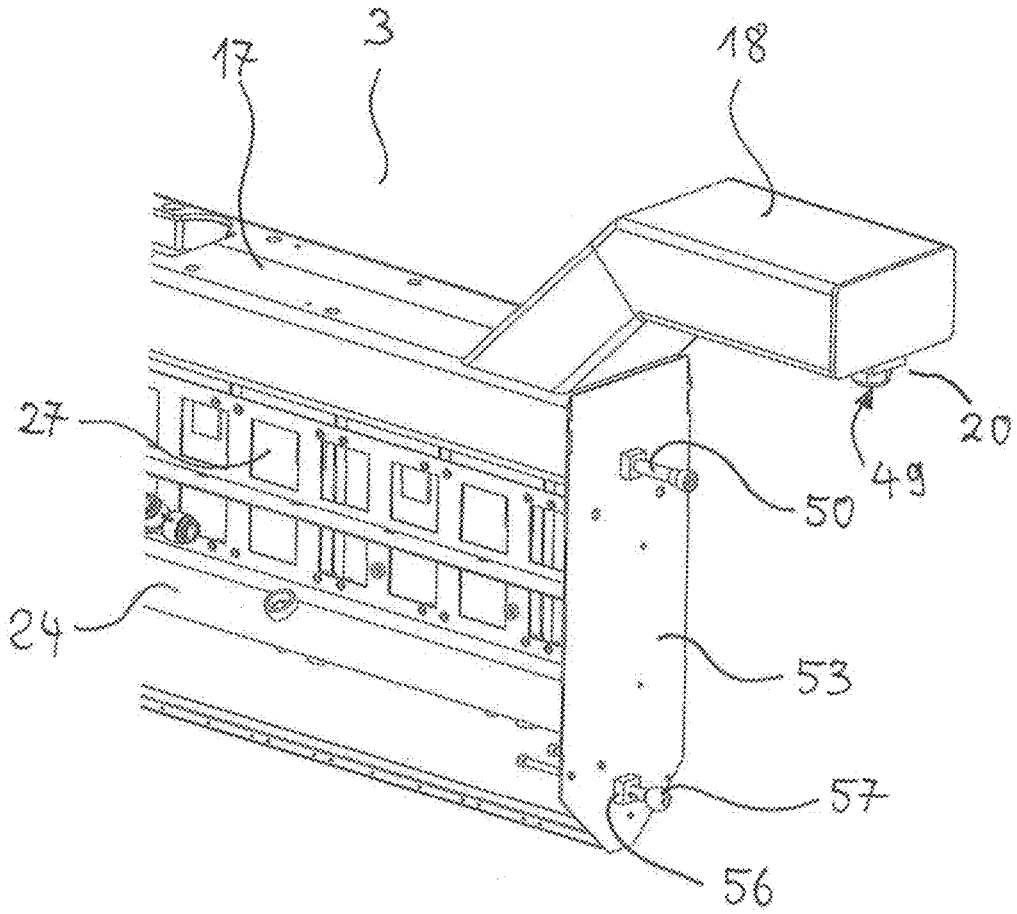
Fig. 3
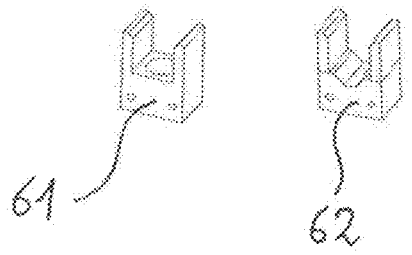

PRINT-HEAD MODULE

CROSS-REFERENCE TO RELATED APPLICATION

This is a continuation application, under 35 U.S.C. § 120, of copending international application No. PCT/EP2014/078587, filed Dec. 18, 2014, which designated the United States.

BACKGROUND OF THE INVENTION

Field of the Invention

The invention relates to a print-head module for a single-pass inkjet printer, which print-head module contains a housing component with a transverse bracket, on which a number of print heads are arranged which are adjusted positionally with respect to at least one reference position. Furthermore, the invention relates to a single-pass inkjet printer having a print-head module of this type.

Whereas, in the case of a conventional inkjet printer, the print heads which are mounted on a carriage spray ink droplets line-by-line in the transverse direction onto the medium which is transported discontinuously in the running direction, the print heads in the case of a single-pass inkjet printer are mounted in print-head modules of the type mentioned at the outset in the transverse direction over the entire width of the printing medium. The printing medium is moved continuously in the running direction. Whereas, in the case of a conventional inkjet printer, printing speeds of up to 2 meters per minute are achieved, printing speeds of up to over 50 meters per minute can be achieved by way of a single-pass inkjet printer. For color printing, a plurality of print-head modules are mounted one behind another in the running direction in the case of a single-pass inkjet printer. Here, the print-head modules are in each case assigned a primary color, in particular cyan, magenta and yellow and possibly black. Print-head modules with a special ink are added for special print uses.

A single-pass inkjet printer is suitable, in particular, for industrial use, in which bulk goods have to be printed, and it therefore comes down to a high throughput. A single-pass inkjet printer is likewise suitable for printing large-area objects on account of the high printing speeds. A single-pass inkjet printer is therefore suitable, in particular, for industrial applications of the furniture or ceramic industry, where floor coverings, such as laminates or ceramic tiles, worktops, moldings or the like are to be provided with a decoration. Here, a very wide variety of inks are used which are resistant, for example, with respect to a later protective covering.

In comparison with conventional printing methods, such as gravure printing, the single-pass inkjet printer is also used precisely in the case of small batch sizes, where the production of an impression roll is not worthwhile. In contrast, a single-pass inkjet printer also makes individualization possible of the decoration and what are known as impossible decorations which cannot be achieved by way of rolls. The single-pass inkjet printer is not limited to a continuous repetition of one print pattern or repeat, as is the case in rotary printing.

A print-head module for a single-pass inkjet printer achieves dimensions of more than 1 m in the transverse direction and vertically, a tendency to even larger printing widths and therefore to a further increase in the dimensions prevailing. The individual print heads which are combined in the transverse bracket of the print-head module reach widths of up to several tens of centimeters. Here, resolutions of up to 600×600 dpi (dots per inch) and more are achieved. Here, several thousand nozzles are contained per print head. Accordingly, a plurality of print heads are arranged in the print-head module, which print heads for their part contain a multiplicity of print nozzles. In particular, the transverse bracket of the print-head module extends over the entire printing width or over the entire width of the printing medium.

Positional deviations of a few micrometers (μm) are visible in a printed image using the human eye. In the case of the abovementioned resolutions, the individual nozzles of a print head lie only a few tens of micrometers apart from one another. The size of an image or printed dot itself is in the range of 10 micrometers. It can be seen that, in the case of a single-pass inkjet printer with a plurality of print-head modules which are arranged behind one another in the running direction of the medium, an adjustment of the print heads in the micrometer range becomes necessary, in order to produce a high quality printed image. The adjustment of a print-head module in a single-pass inkjet printer is therefore complicated. The position of the print heads has to be detected, for example, by light microscope and has to be manually set in a complicated manner. The construction of a single-pass inkjet printer is therefore comparatively arduous. An adjustment also has to be carried out after each replacement of a print-head module. This leads to an unnecessary extension of the down times.

International patent disclosure WO 2011/157281 A1 discloses a print-head module of the type mentioned at the outset. On its housing, the print-head module has a hanging part for suspension which is oriented by way of gravity. The print heads which are arranged on the housing are positionally adjusted with respect to at least one reference position. The suspended fastening of the print-head module which is possible via the hanging part permits facilitated installation and dismantling in the vertical direction. At the same time, the suspended arrangement of the print-head module makes automatic orientation possible on account of gravity which acts on the center of gravity. During the insertion of the suspended print-head module, there is already rough positioning with respect to a later printing position which is fixed on the unit, as a result. In particular, the suspended fastening permits automatic adjusting of the print-head module into the printing position which is fixed on the unit, to which end, for example, open bearing elements are provided on the single-pass inkjet printer, into which open bearing elements bearing pieces of the print-head module drop with exact orientation during lifting. Subsequent manual adjustment is not necessary. Via the print heads which are positionally adjusted with respect to a reference position, a likewise exact orientation of the print heads with respect to the single-pass inkjet printer is achieved with an exact orientation of the print-head module.

SUMMARY OF THE INVENTION

The invention is based on the object of achieving a further increase in the dimensions of the print-head module and therefore the printing width which can be achieved of a single-pass inkjet printer, to be precise without the positioning accuracy of the print heads being reduced.

According to the invention, the object is achieved for a print-head module for a single-pass inkjet printer by virtue of the fact that a housing component has a transverse bracket which extends in the X-direction and on which a number of print heads are arranged which are positionally adjusted with respect to at least one reference position. A support frame having a rest device for resting the support frame is included, the housing component being mounted on the support frame such that it can swing about a swing axis.

Furthermore, the object which is set is achieved according to the invention by way of a single-pass inkjet printer which has a frame construction and at least one print-head module of the abovementioned type. The support frame of the print-head module is deposited by the rest device on at least one support which is arranged on the frame construction.

Here, the invention proceeds in a first step from the fact that undesired positional changes of the print heads occur on account of the growing inherent weight in the case of an enlargement of a print-head module which is known from the prior art. The housing of the print-head module changes its shape under weight loading. In the case of dimensioning of the print-head module beyond widths of 1 m in the transverse direction or X-direction, the exact positioning of the print heads is difficult on account of the given deformation.

In a second step, the invention proceeds from the consideration of reducing the weight loading on the housing component which supports the print heads, in order to reduce the material loadings by way of inherent weight as a result. A material reinforcement in the print-head module for improving its dimensional stability would lead in an undesired manner to a further weight increase, as a result of which the structural and material outlay for mounting it would increase and the handling of the print-head module during mounting and dismantling would become more difficult.

In order to reduce the weight loading on the housing component which supports the print heads, the invention provides a support frame which is deposited by means of the rest device on a support of the single-pass inkjet printer. The weight of the support frame is therefore absorbed by the support of the single-pass inkjet printer. The housing component per se which supports the print heads is mounted on the support frame in a suspended manner. As a result, furthermore, there is simple automatic orientation as a result of gravity while being lifted into the single-pass inkjet printer. The support frame affords the option of receiving heavy components of the print-head module, such as the control boards of the print heads or supply lines for operating medium, lines for electric energy, control lines for information signals, lines or pipes for air or electric fuses, etc. The housing component is relieved of weight. The support frame also affords the possibility of removing weight structurally at predefined positions and, as a result, of designing the loading of the housing component which supports the print heads in a defined manner. In other words, the invention provides a division of the print-head module into a support frame which can be deposited and into a suspended housing component which supports the print heads.

The invention therefore affords the advantage of further increasing the dimension of the print-head module precisely in the transverse or X-direction in order to achieve greater printing widths, the possibility of simple and precise adjustment of the print heads being retained, however. Part of the weight of the print-head module is dissipated via the support frame into the support of the single-pass inkjet printer. Possible material deformation of the housing component which supports the print heads as a result of inherent weight is reduced to a minimum.

The print-head module, in particular the transverse bracket which supports the print heads, preferably extends over the entire printing width or over the entire width of the printing medium. By way of the invention, printing widths and therefore transverse dimensions of the print-head module or the transverse bracket of over 2 m are achieved. At the same time, furthermore, there is an exact positioning capability of the print heads in the micrometer range.

An orthogonal coordinate system is used for the further description, the three spatial directions being denoted by X-direction, Y-direction and Z-direction. The directions which are used relate to the positive space sector.

Accordingly, if a component is situated "above" another component along one of the spatial axes, its corresponding axial section is greater. Conversely, the axial section of a component is smaller if it is situated "below" another component with regard to the stated spatial axis.

In one preferred refinement of the print-head module, the swing axis is situated above the transverse bracket of the housing component in the Z-direction, which transverse bracket receives the print heads. In other words, the transverse bracket "hangs" on the support frame, with the result that, if the print-head module is lifted in vertically, it can be positioned below the swing axis in a manner which is oriented by way of gravity and can be pivoted about an inclination or polar angle with respect to the support frame. As a result, even inclined printing positions which are fixed on the unit can be achieved in a simple way as a result of self-adjustment during lifting in, which printing positions are necessary, for example, in the case of a technically desired arcuate course of the printing medium.

The swing axis is further advantageously oriented parallel to the X-direction, that is to say in a transverse direction which is perpendicular with respect to the running direction of the printing medium. In this way, the swing axis runs parallel to the main direction of the transverse bracket. Swinging of the transverse bracket about the swing axis then does not lead to a change in the azimuth angle. An azimuthal rotation of the print-head module or the transverse bracket is given, for example, via a corresponding movement of the support frame in the support. As an alternative or in addition, a small play is preferably provided in the bearing of the swing axis, in order to permit a small azimuthal rotation of the housing component or the transverse bracket with respect to the support frame.

In a further preferred refinement of the print-head module, the rest device of the support frame is arranged above the swing axis in the Z-direction. In other words, the support frame and therefore the housing component which swings on it "hang" on the rest device. The print-head module which is deposited on the support of the single-pass inkjet printer swings downward in the case of a gravity-oriented orientation. As a result, in addition to simple mounting and dismantling in the vertical direction, it is possible to deposit the print-head module in its entirety on the support without further aids or fastening device. As a result of gravity, the deposited print-head module remains stably deposited on the support on account of its inherent weight. To this end, the center of mass of the print-head module is expediently arranged below the rest device of the support frame with regard to the Z-direction. In particular, this is optionally to be taken into consideration if further modules are placed onto the support frame.

The support frame preferably contains two support arms which are spaced apart from one another in the X-direction, the rest device being arranged in the region of the free ends of the support arms. Support arms afford the possibility of structurally moving the rest point of the support frame. For example, the support arms are extended laterally in the X-direction in each case beyond the transverse bracket. As a result, the support can be arranged on the single-pass inkjet printer structurally spaced apart from the housing component, which is in turn advantageous for a desired self-adjustment of the print-head module and, in particular, of the housing component during lifting into corresponding bearing means of the single-pass inkjet printer.

The support frame expediently contains a cross-member which extends in the X-direction and is arranged above the swing axis in the Z-direction. The mechanical stability of the print-head module is increased via a cross-member of this type. Further modules are possibly placed onto the cross-member. The weight-supporting components of the print-head module are mounted on the crossmember directly or indirectly via a corresponding frame construction.

Mounting aids for lifting in and out in the vertical direction in a manner which is oriented freely by way of gravity are further advantageously arranged above the center of mass of the print-head module in the Z-direction. Via mounting aids of this type, the print-head module is oriented automatically by means of gravity substantially according to the printing position which is fixed on the unit and is to be achieved. During the mounting, a precision adjustment in the sense of a deviation from the gravity-oriented orientation of the print-head module, such as an inclination or an azimuthal rotation, or else an offset in the X-direction or Y-direction takes place by way of the corresponding bearing means of the single-pass inkjet printer, since the print-head module is lifted in such that it is suspended in a freely movable manner. In particular, the mounting aids are configured as a cord fastening device, the mounting and dismantling of the print-head module being brought about in the vertical direction by means of a cord lifting system.

In a further preferred refinement of the print-head module, a coupling module is placed onto the support frame in the Z-direction, which coupling module contains a first coupling part with a plurality of first connectors at least for supplying operating media and for providing electric energy, the support frame containing a second coupling part with a plurality of second connectors which are complementary to the first connectors, and it being possible for the first coupling part and the second coupling part to be decoupled and coupled mechanically to one another with the production of a connection between the first connectors and the second connectors. In other words, the coupling of the coupling module to the print-head module takes place via a multi-coupling which both connects different connectors for operating medium, power, control signals, etc. during coupling and produces a mechanical connection. For example, the mechanical connection of the coupling parts is produced via a screw connection. The coupling of the first and second connectors is also carried out upon approach of the two coupling parts. Conversely, the decoupling takes place by way of releasing of the screw connection, the complementary connectors moving away from one another. The screw connection is preferably of, in particular, motor-driven configuration. A securing device is preferably included which prevent unintentional opening of the coupled parts.

The provision of a coupling module which is connected mechanically and in terms of connection by a multi-coupling to the print-head module or its support frame affords several advantages. For example, a simplified connection of the print-head module to the control and supply lines is possible as a result. The actuation and the supply of the multiplicity of print heads therefore take place via a single central module. Secondly, the load of supplied control and supply lines is also dissipated via the support frame as a result, without loading the housing component which supports the print heads. The coupling module is particularly preferably supplemented by supplying containers, such as ink tanks. Their weight also does not act on the housing component which supports the print heads. Furthermore, the coupling module permits simple decoupling and coupling of the print-head module via the multi-coupling, which is appropriate with regard to repair and maintenance work. There is easier accessibility of the print-head module when the coupling module is removed. Overall, therefore, the print-head module is easier to maintain and repair. In addition, it can be installed and dismantled more easily.

The coupling module is expediently placed on the cross-member of the support frame. Here, the mounting aids are advantageously arranged on the coupling module. The weight of the coupling module is absorbed by the support frame directly via the cross-member. The print-head module can be both lifted into and out of the single-pass inkjet printer via the coupling module. Via the multi-coupling, the print-head module can both be received and deposited easily.

In a further appropriate refinement of the print-head module, the housing component contains two side cheeks which extend in the Z-direction and are connected to the transverse bracket, the support frame being arranged between the side cheeks. In other words, the housing component is given a bracket shape or U-shape overall as a result, the limbs being formed by the side cheeks. The swing axis is defined, in particular, by in each case one rotary bearing at the free ends of the side cheeks, the swing axis penetrating the side cheeks in each case at the rotary bearing.

In one preferred refinement, the or each rotary bearing is configured as a radial plain bearing. A radial plain bearing permits an offset of the transverse bracket, which supports the print heads, of the swinging housing component along the swing axis with respect to the support frame. This facilitates the precision positioning of the print-head module during mounting.

The or each radial plain bearing is particularly preferably formed by a guide pin which extends in the X-direction and is guided through an opening with oversize. As a result, additional degrees of freedom in the X-direction and Y-direction with respect to the support frame are afforded to the transverse bracket of the housing component, which transverse bracket supports the print heads. If the movement play range is additionally to be restricted in one of the two directions for reasons of clear determination of the spatial position of the housing component, this takes place by way of a corresponding reduction in the play between the opening and the guide pin. In particular, an opening is preferably configured as a slot, the zero play being restricted, for example, in the Y-direction. If, in the case of two plain bearings of this type, one opening is configured as a slot with an orientation in the Z-direction and the other opening is configured as a round bore with oversize, an azimuthal rotation of the housing component with respect to the support frame is made possible, the pivot point being fixed, however, by way of the one plain bearing with a slot.

The guide pin of the or each radial plain bearing is expediently mounted on the support frame, which guide pin is guided in an opening on the housing component, in particular in a side cheek. A configuration of this type makes simple mounting of the housing component on the support frame possible. To this end, for example, the guide pin is configured as a guide screw.

In each case one side wall is further preferably mounted on both sides on the transverse bracket and on the side cheeks of the housing component. The housing component is stabilized mechanically via the side wall. Inner components which are contained in the housing component can also be supported against the side wall, whereas, in the case of an open configuration, a movement of components of this type can lead to undesired rotation of the transverse bracket which supports the print heads.

In one preferred refinement, the rest device of the support frame comprise in each case one planar rest face which extends in the X-Y plane. In the case of a fixed Z-position, a rest face of this type makes depositing of the support frame and therefore of the print-head module possible in a manner which is variable in the X-Y plane. Here, the depositing position of the support frame in the X-Y plane results by way of the automatic position adjustment during lowering of the print-head module by means of the counter-bearings or a catching device which is provided correspondingly on the single-pass inkjet printer.

At least one supporting bearing is advantageously additionally included for supporting the support frame on the housing component in the Y-direction. A weight proportion of the support frame is dissipated as required into the housing component via a supporting bearing of this type. As a result, the assumed and desired position of the transverse bracket which supports the print heads is optionally stabilized during operation of the single-pass inkjet printer. The supporting bearing is configured, in particular, in such a way that, in the case of an offset in the Z-direction, it increases the freedom of movement in the Y-direction during lifting out of the print-head module, and therefore permits the swing movement or an inclination of the housing component with respect to the support frame about the polar angle in the lifted-out position of the print-head module. In the lifted-in state, the supporting bearing is then preferably configured in such a way that it restricts the degrees of freedom in the Z-direction and in the Y-direction. In particular, a ball pivot bearing is provided as supporting bearing. Two supporting bearings are preferably provided which are spaced apart from one another in the X-direction. To this end, a fixed/floating bearing or a floating/floating bearing is expediently used as bearing combination with regard to the X-direction. Here, one of the supporting bearings is preferably configured as a fixed bearing and the other one of the supporting bearings is configured as a fixed bearing. Here, the fixed bearing is preferably configured as a ball pivot bearing with a conical or ball socket. The floating bearing is advantageously configured as a prism thrust bearing, in particular is likewise configured as a ball pivot bearing. Here, a prism socket which runs in the X-direction is provided. A configuration of this type allows a longitudinal offset of the transverse bracket support in the X-direction to be absorbed, which longitudinal offset is produced, for example, as a result of a temperature change loading.

At least two bearing pieces which are spaced apart in the X-direction are advantageously arranged on the housing component of the print-head module, which bearing pieces are in each case configured for self-adjusting positioning in an open bearing. In particular, when the catching device for rough positioning in relation to the bearing seat of the bearing pieces are further preferably arranged on the housing component, the bearings which are self-adjusting, in particular, in the vertical direction are not of complicated construction. It is merely necessary that the two bearing elements which realize the bearing find one another automatically during the gradual introduction of the print-head module in a vertical orientation which is, in particular, gravity-oriented, as a result of which the final printing position is ultimately fixed. Suitable bearing pieces are configured for interaction with, for example, a socket bearing, knife-edge bearing or jewel bearing. To this extent, the bearing pieces are, in particular, of conical, tapered, angular, pointed or spherical configuration.

In a further preferred refinement, the bearing pieces are mounted on the housing component in a height-adjustable manner. In this way, production-related dimensional tolerances can be compensated for or the print heads can be adjusted vertically or in the Z-direction with respect to the printing position.

In a preferred refinement, one of the bearing pieces is configured for positioning in a fixed bearing and the other one of the bearing pieces is configured for positioning in a floating bearing in the X-direction or transverse direction. Via the floating bearing, for example, an expansion of the print-head module in the transverse direction is once again absorbed. In one expedient refinement, in each case the fixed bearing is configured as a ball pivot bearing and the floating bearing is given by way of a prism thrust guide in the transverse direction. To this end, the bearing pieces are preferably configured in each case as ball pivots. The fixed bearing is then advantageously equipped with a ball socket for punctiform rotary mounting, into which ball socket the ball end of the pivot is received and positioned during the vertical introduction of the print-head module. The prism thrust guide is likewise configured, in particular, as a ball pivot bearing, the socket being configured, however, with a prism-shaped cross section along the transverse direction. The prism thrust guide then fixes the parallel position of the print-head module with respect to the transverse direction. There is still a linear offset as one degree of freedom in the transverse direction itself.

A stop piece for coming into contact with a stop face is further preferably arranged on the print-head module. A stop piece of this type orients, in particular, the inclination of the print-head module about the polar angle when the print-head module is lifted in vertically.

The stop piece particularly advantageously contains a ball pivot which extends in the transverse direction or X-direction. During a movement of the hanging print-head module into the printing position, the ball pivot passes gradually into contact with a stop face which is fixed on the unit and finally positions the ball pivot in the Y-direction or running direction of the printing medium. Together with a, for example, spherical stop face, a ball pivot permits a defined stop independently of the vertical height. In the final printing position, the respective print-head module is then fixed exactly, for example, by way of the two open bearings, namely a ball pivot bearing as fixed bearing and a prism thrust guide as floating bearing, and by way of the stop piece which abuts the stop face. The inclination or polar angle is fixed by way of the abutting stop piece. The corresponding guidance is assumed by the stop piece in interaction with the vertical stop face which is fixed on the unit.

By way of the fixing of the position of the print heads with respect to at least one reference position, they are always oriented identically apart from unavoidable dimensional tolerances when the printing position of the print-head module is reached. In other words, each print-head module always has the same positional orientation of its respective print heads with regard to at least one reference position. As a result, a simple exchange of the print-head module is achieved. The position of the print heads of the replaced print-head module and a newly inserted print-head module are identical with regard to the unit side.

Complicated readjustment of an inserted print-head module is dispensed with by way of said measure. The print heads are already adjusted apart from dimensional tolerances after the simple insertion of the print-head module. The print-head modules have to first of all be oriented in the respective bearing points on the unit side on account of production tolerances merely in the case of a new construction of the single-pass inkjet printer. Even this is simple on site, however, by way of the identical pre-positioning of the print heads of all print-head modules.

For the purpose of the positional adjusting of the print heads, the latter are mounted in the print-head module such that they can be displaced, for example, in the X-direction and in the Y-direction. In a suitable tool, the print-head module is moved for positional adjustment into a mounting position which is comparable with the later printing position, before being delivered. Subsequently, the individual print heads are positionally adjusted, for example, by light microscope in the micrometer range with respect to a reference position.

The print heads are preferably positionally adjusted in each case with respect to the bearing pieces, for example the ball pivots. To this end, before being delivered, the print-head modules are introduced into the corresponding workpiece in accordance with the later printing position. The tool has the identical bearings to the later single-pass inkjet printer. The print heads are parallelized, in particular, and are oriented in the X-direction and in the Y-direction.

The single-pass inkjet printer which receives the print-head module preferably has a support for counter-bearing the support frame, which support has a planar rest face which is supported by a ball joint. By way of a ball joint which is, in particular, freely movable, the rest face of the support is oriented automatically parallel to the rest face of the rest device of the support frame during depositing of the print-head module. Therefore, stable (since flat) depositing of the print-head module on the single-pass inkjet printer takes place automatically as a result. The orientation of the ball joint results in flat contact, in particular when the print-head module has an inclination angle in the printing position in the case of an arcuately guided printing medium.

If provided, the at least two bearing pieces of the housing component of the at least one print-head module which are spaced apart in the X-direction are preferably positioned in in each case one open bearing which is arranged on the frame construction of the single-pass inkjet printer. The resulting corresponding advantages of simple self-adjustment have already been described in the above text.

The stop piece of the housing component of the at least one print-head module expediently bears against a stop face which is arranged on the frame construction of the single-pass inkjet printer. As has been described above, an exact and reproducible orientation of the print-head module takes place as a result.

Other features which are considered as characteristic for the invention are set forth in the appended claims.

Although the invention is illustrated and described herein as embodied in a print-head module, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 3 is a perspective view of the support frame of the print-head module according to FIG. 1 in an enlarged detail view.

DETAILED DESCRIPTION OF THE INVENTION

Figure 1:
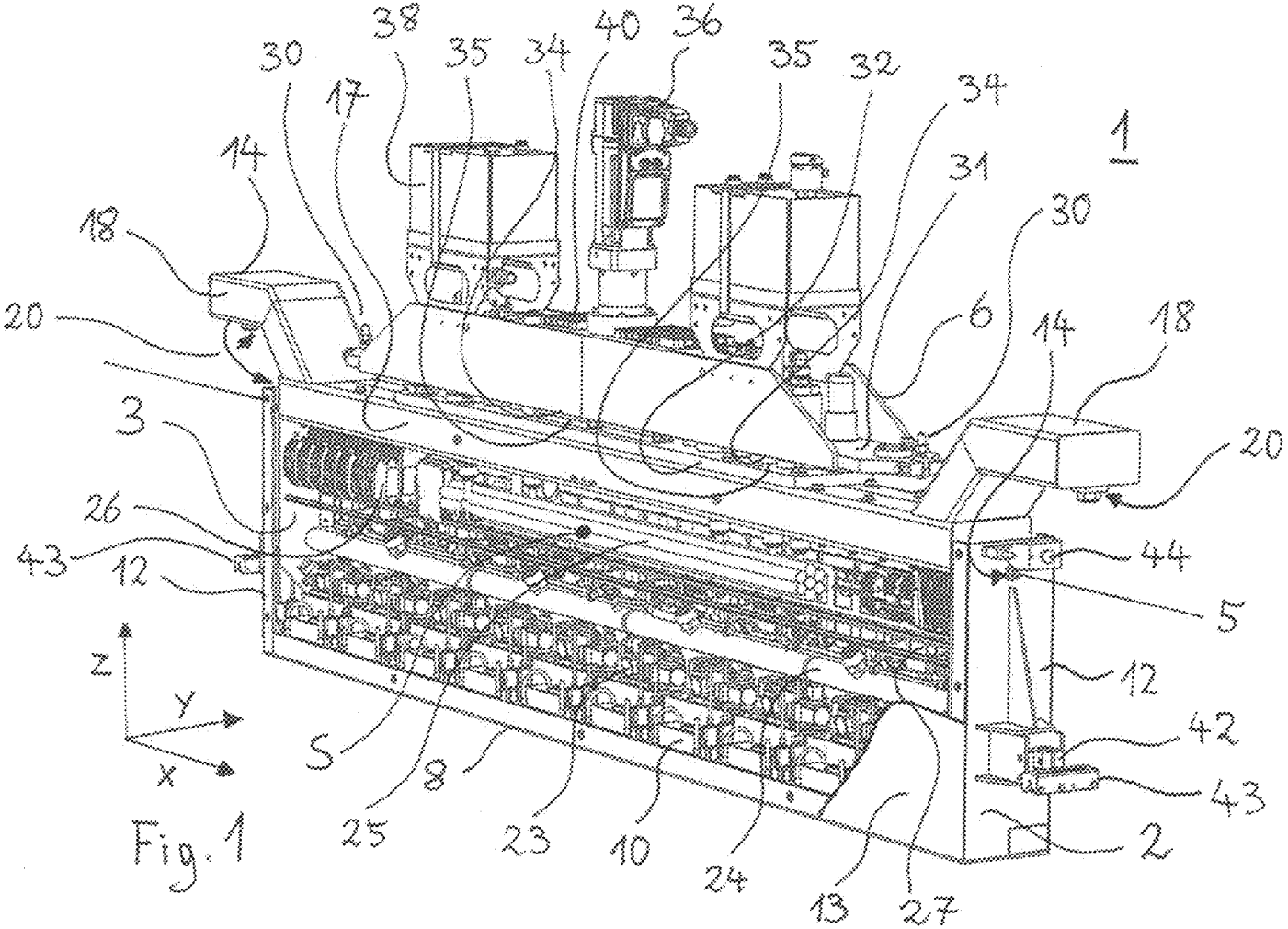
FIG. 1 is a diagrammatic, perspective view of a partially broken-open, three-dimensional illustration of a print-head module for a single-pass inkjet printer having a support frame, having a housing component which is mounted in a swinging manner thereon with print heads, and having a coupling module which is placed onto the support frame according to the invention.

Referring now to the figures of the drawings in detail and first, particularly to FIG. 1 thereof, there is shown a three-dimensional and partially broken-open illustration of a print-head module 1 for a single-pass inkjet printer. The print-head module 1 contains a housing component 2 which is mounted in a swinging manner on a support frame 3. A corresponding swing axis 5 is illustrated. Furthermore, a coupling module 6 is placed on the support frame 3.

The housing component 2 which is mounted on the support frame 3 such that it can swing about the swing axis 5 contains a transverse bracket 8 which extends in the X-direction and along which a plurality of print heads 10 which are positionally adjusted with respect to one another are mounted. The transverse bracket 8 is fastened between two side cheeks 12 which extend in each case in the Z-direction. In each case one side wall 13 is mounted on both sides on the transverse bracket 8 and on the side cheeks 12. The side wall 13 mechanically stabilizes the housing component 2. It also prevents an undesired movement of components which are received in the interior of the print-head module 1.

The swing axis 5 is defined by two radial plain bearings 14 which are situated in each case at the upper ends of the side cheeks 12. The housing component 2 can be pivoted about the swing axis 5 with respect to the support frame 3. A linear offset of the housing component 2 with respect to the support frame 3 is also made possible along the X-direction.

The support frame 3 contains a cross-member 17 which likewise extends in the X-direction and on which support arms 18 are mounted on both sides which extend beyond the housing component 2 in the X-direction. A rest device 20 for counter-bearing or depositing on a corresponding support, which is fixed to the unit, of the single-pass inkjet printer are configured in each case at the free ends of support arms 18.

The swing axis 5 and the rest device 20 are arranged above the center of mass S of the print-head module 1 in the Z-direction. The swing axis 5 is likewise defined above the transverse bracket 8 which supports the print heads 10. In other words, in the case of a gravity-oriented orientation, the transverse bracket 8 hangs below the support frame 2 or below the cross-member 17. The print-head module 1 per se with the support frame 3 and the housing component 2 also hangs below the rest device 20. To this extent, the print-head module 1 which is deposited on the rest device 2 is already oriented by gravity in accordance with a provided printing position which is fixed on the unit, and to this extent can be lifted in and out of the single-pass inkjet printer easily.

The transverse bracket 8 with the print heads 10 which are arranged therein extends over the entire printing width or over the entire width of a printing medium. The transverse bracket 8 has, for example, a length of 2.5 m.

The corresponding supply and drive units 23 for the print heads 10, operating and supply lines 24, cable bundles 25 for supply and control lines, electric fuses 26 and the control boards 27 for the print heads 10 are mounted on the support frame 3 via a corresponding frame construction. As a result, the housing component 2 and therefore, in particular, the transverse bracket 8 which supports the print heads 10 are relieved of weight. The housing component 2 supports merely the print heads 10 per se. The print heads 10 themselves are mounted such that they can be displaced on the transverse bracket 8 in the X-direction and in the Y-direction.

A dimensional enlargement of the print-head module 1 is possible by way of the weight relief of the housing component 2 which supports the print heads 10. The print heads 10 can be positioned exactly in the printing position on the single-pass inkjet printer. A positional change of the print heads 10 as a result of a weight-induced material deformation is below the tolerance limit. The position of the print heads 10 can be fixed in the micrometer range and is stable. The weight of many components of the print-head module 1 is transmitted to the support frame 3. The support frame 3 is deposited via the rest device 20 on counter-bearing on the single-pass inkjet printer. The main weight of the print-head module 1 is absorbed by the corresponding support via the rest device 20.

In order to lift the print-head module 1 in and out in a vertical and gravity-oriented orientation, mounting aids 30 are provided on the coupling module 6, on which mounting aids 30 a cord of a cord lifting system is mounted. The coupling module 6 is placed mechanically and in connection terms on the cross-member 17 of the support frame 3 via a multi-coupling. To this end, the coupling module 6 contains a first coupling part 31 which couples to a second coupling part 32 which is connected fixedly to the cross-member 17.

The first coupling part 31 has a number of first connectors 34. Accordingly, second connectors 35 which are complementary to the first connectors 34 are included by the second coupling part 32. The first and second connectors 34, 35 are configured as operating medium lines, as control lines or as electric lines for energy supply. Mechanical coupling of the first coupling part 31 and the second coupling part 32 takes place via a motor 36, for example by a screw connection, the first connectors 34 being connected at the same time to the second connectors 35. Here, in particular, operating medium lines are coupled to one another in a manner which is sealed with respect to operating medium. Furthermore, ink tanks 38 are arranged on the coupling module 6. Furthermore, a strain relief device(s) 40 for the corresponding cable leadthroughs are mounted.

Here, bearing pieces 42 for positioning in an open bearing of the single-pass inkjet printer are mounted on the housing component 2, in each case on its side cheeks 12. The bearing pieces 42 are configured, for example, as height-adjustable ball pivots. The corresponding bearing elements on the single-pass inkjet printer are configured as upwardly open bearing sockets with a conical or ball socket or with a prism socket. In addition, a catching device 43 is mounted in each case on the side cheeks 12 of the housing component 2. The catching device 43 is configured, for example, with a wedge shaft which, during lowering of the print-head module 1, comes into contact with a catching wedge on the single-pass inkjet printer and is oriented as a result, with the result that the print-head module 1 is deposited automatically during lowering with the respective bearing pieces 42 into the bearing sockets of the open bearings and in the process reaches the desired and exactly oriented printing position. To this end, a corresponding play of the housing component 2 with respect to the support frame 3 is permitted via the radial plain bearings 14 of corresponding configuration. Variable positioning in the X-Y plane on the single-pass inkjet printer is also made possible via a flat rest face of the rest device 20. Fixing in the Y-direction takes place via the stop piece 44 during lifting in.

Figure 2:
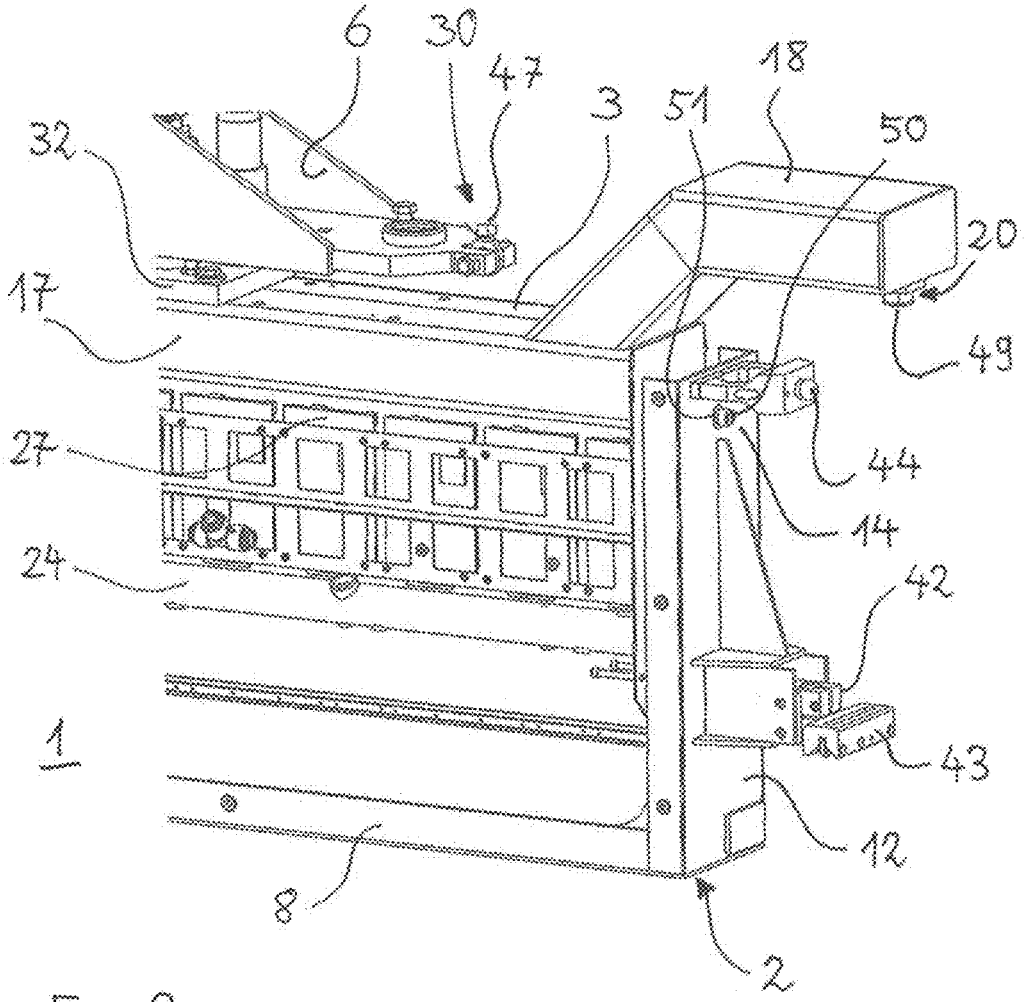
FIG. 2 is a perspective view of the print-head module according to FIG. 1 in an enlarged detail view.

Details of the bearing can be seen from FIG. 2 in an enlarged detail view of the print-head module 1 according to FIG. 1. The stop piece 44 is configured as a ball pivot which is oriented and fixed in a prism guide in the Y-direction during lowering. The mounting aids 30 are configured as a cord fastening device 47. A height-adjustable bearing piece 42 and the catching device 43 which is fastened thereto can be seen clearly.

The radial plain bearings 14 which are arranged on both side cheeks 12 of the housing component 2 comprise in each case one guide pin 50 which penetrates an opening 51 in the respective side cheek 12. Here, the opening 51 has an oversize, with the result that an offset of the housing component 2 with respect to the support frame 3 is also possible in the Y-Z plane in accordance with the given play. It can likewise be seen that the housing component 2 can be offset linearly along the X-direction along the swing axis 5 with respect to the support frame 3. The planar rest face 49 can be seen on the rest device 20.

The support frame 3, which is received in the housing component 2, of the print-head module 1 according to FIG. 1 can be seen from FIG. 3. As in FIG. 2, the planar rest face 49 on the rest device 20 can be seen. The control boards 27 and operating medium lines 24 are received in the interior of the support frame 3.

The cross-member 17 of the support frame 3 is mounted between two side plates 53 which extend in the Z-direction. In each case the guide pin 50 of the radial plain bearing 14 is screwed in on the two side plates 53. A supporting bearing 56 is formed at the lower end of the side plates 53, by way of which supporting bearing 56 the support frame 3 can additionally be supported on the housing component 2. It is possible as a result to transmit part of the weight of the support frame 3 and the components received therein to the housing component 2 and, in particular, to the transverse bracket 8 which supports the print heads. As a result, the printing position of the housing component 2 on the single-pass inkjet printer can possibly be stabilized.

The supporting bearings 56 which are provided on both sides comprise a ball pivot 57. The ball pivot 57 is mounted on the side plate 53. The correspondingly complementary bearing element is given as a bearing socket which is fastened in each case on the inner side of the corresponding side cheek 12 of the housing component 2.

One of the supporting bearings 56 contains a ball socket or conical socket 61. The other supporting bearing 56 contains a prism socket 62 as complementary bearing element. Whereas the ball or conical socket 61 defines an exact pivot point of the support frame 3 on the housing component 2, a longitudinal offset as a result of a temperature change loading is absorbed in the X-direction via the prism socket 62.

Figure 4:
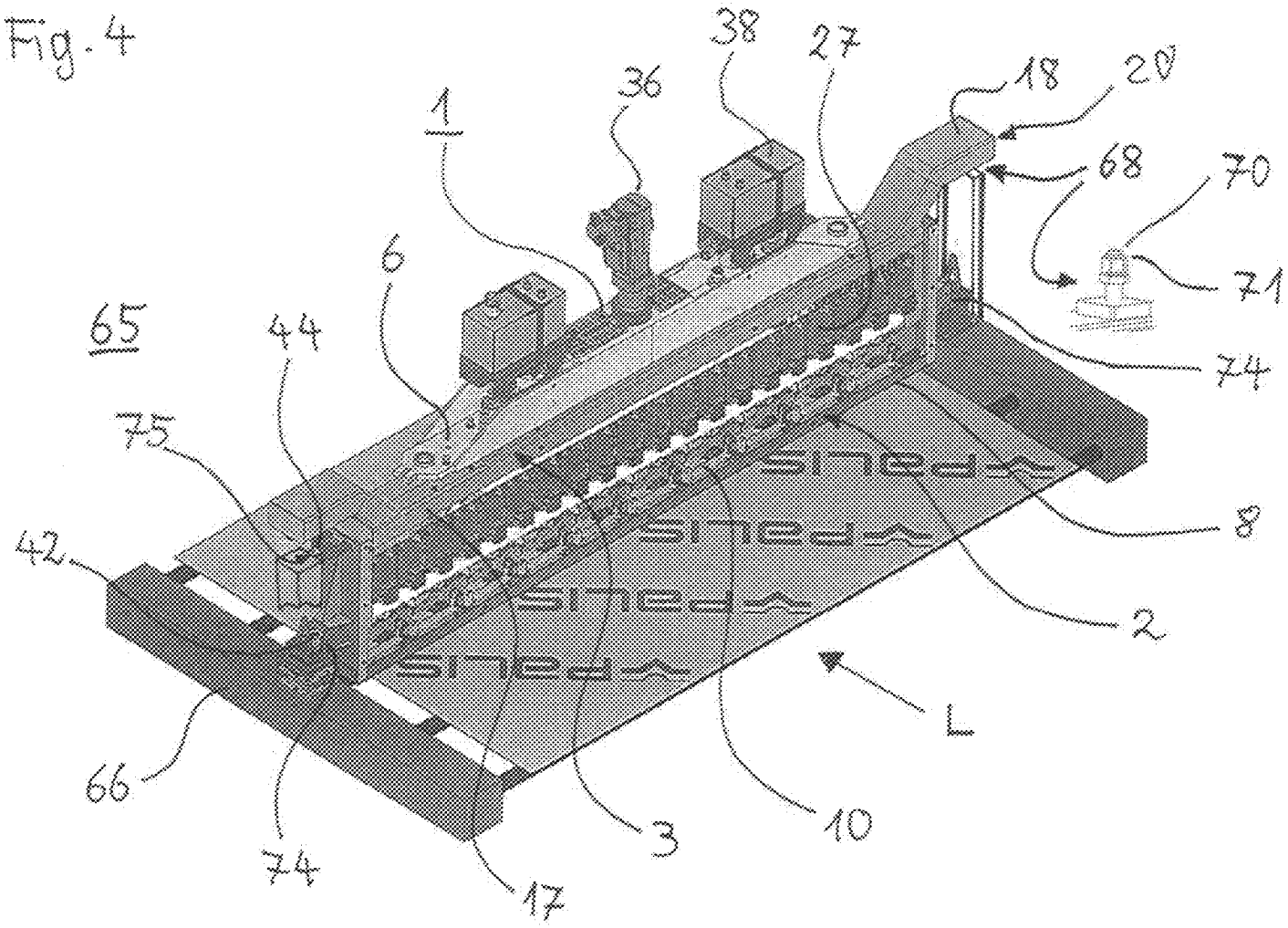
FIG. 4 is a perspective view of a detail of an inkjet printer having a print-head module according to FIG. 1 which is deposited in a printing position which is fixed on the unit.

FIG. 4 shows a single-pass inkjet printer 65. The latter contains a frame construction 66, on which the print-head module 1 according to FIG. 1 is deposited. Thus, in particular, the rest device 20 on the support arms 18 is deposited on a support 68. Here, the support 68 contains a planar rest face 70 which is mounted in a rotatably movable manner in a ball joint 71. The rest face 70 of the support 68 is oriented in the ball joint 71 by way of the weight of the deposited support frame 3, with the result that there is always a flat contact independently of an inclination angle of the print-head module 1.

The bearing pieces 42 on the side cheeks of the housing component 2 are received in corresponding bearing sockets of the open bearings 74 in a positionally adjusted manner. The respective catching device 43 is positioned on corresponding catching wedges.

The stop piece 44 on a side cheek of the housing component 2 is defined with respect to a stop face 75 on the frame construction 66. The running direction L of a printing medium can be seen.

The following is a summary list of reference numerals and the corresponding structure used in the above description of the invention:

1 Print-head module
2 Housing component
3 Support frame
5 Swing axis
6 Coupling module
8 Transverse bracket
10 Print heads
12 Side cheek
13 Side wall
14 Radial plain bearing
17 Crossmember
18 Support arm
20 Rest means
23 Supply and drive unit
24 Operating medium line
25 Cable bundle
26 Fuses
27 Control boards
30 Mounting aid
31 First coupling part
32 Second coupling part
34 First connectors
35 Second connectors
36 Motor
38 Ink tank
40 Strain relief means
42 Bearing piece
43 Catching means
44 Stop piece
47 Cord fastening means
49 Rest face
50 Guide pin
51 Opening
53 Side plate
56 Supporting bearing
57 Ball pivot
61 Ball socket
62 Prism socket
65 Single-pass inkjet printer
66 Frame construction
68 Support
70 Rest face
71 Ball joint
74 Open bearing
75 Stop face
L Running direction
S Center of mass

The invention claimed is:

1. A print-head module for a single-pass inkjet printer, comprising:

a number of print heads;

a swing axis;

a housing component having a transverse bracket extending in an X-direction and on said transverse bracket said number of print heads are disposed and are adjusted positionally with respect to at least one reference position; and a support frame having rest devices for mounting the print-head module on a frame construction of a single pass ink-jet printer, said housing component being mounted on said support frame such that said housing component can swing about said swing axis.

2. The print-head module according to claim 1, wherein the swing axis is disposed above said transverse bracket in a Z-direction.

3. The print-head module according to claim 1, wherein said swing axis is oriented parallel to the X-direction.

4. The print-head module according to claim 1, wherein said rest devices of said support frame are disposed above said swing axis in a Z-direction.

5. The print-head module according to claim 1, wherein said rest devices of said support frame are disposed above a center of mass of the print-head module in a Z-direction.

6. The print-head module according to claim 1, wherein said support frame has two support arms which are spaced apart from one another in the X-direction, and said rest devices are disposed in a region of free ends of said support arms.

7. The print-head module according to claim 1, wherein said support frame has a cross-member which extends in the X-direction and is disposed above said swing axis in a Z-direction.

8. The print-head module according to claim 7, further comprising a coupling module being placed onto said support frame in the Z-direction, said coupling module having a first coupling part with a plurality of first connectors at least for supplying operating media and for providing electric energy; and wherein said support frame has a second coupling part with a plurality of second connectors which are complementary with respect to said first connectors, and it being possible for said first coupling part and said second coupling part to be decoupled and coupled mechanically from and to one another with a production of a connection between said first connectors and said second connectors.

9. The print-head module according to claim 8, wherein said coupling module is placed on said cross-member.

10. The print-head module according to claim 9, further comprising mounting aids being disposed on said coupling module.

11. The print-head module according to claim 1, further comprising mounting aids for lifting in and out in a vertical direction in a manner which is oriented freely by way of gravity being disposed above a center of mass of the print-head module in a Z-direction.

12. The print-head module according to claim 1, wherein said housing component has two side cheeks which extend in a Z-direction and are connected to said transverse bracket, and said support frame being disposed between said side cheeks.

13. The print-head module according to claim 12, further comprising side walls, in each case one of said side walls being mounted on both sides on said transverse bracket and on said side cheeks of said housing component.

14. The print-head module according to claim 1, wherein said rest devices have in each case one planar rest face which extends in an X-Y plane.

15. The print-head module according to claim 1, further comprising at least one radial plain bearing, said swing axis being fixed by way of said at least one radial plain bearing.

16. The print-head module according to claim 15, wherein:

said housing component having an opening formed therein; and said at least one radial plain bearing has a guide pin which is oriented in the X-direction and is guided through said opening with oversize.

17. The print-head module according to claim 16, wherein said guide pin of said at least one radial plain bearing being mounted on said support frame and being guided in said opening on said housing component.

18. The print-head module according to claim 1, further comprising at least one supporting bearing for supporting said support frame on said housing component in a Y-direction.

19. The print-head module according to claim 18, further comprising at least two supporting bearings being spaced apart in the X-direction, one of said supporting bearings being configured as a floating bearing and another of said supporting bearings being configured as a fixed bearing with regard to the X-direction.

20. The print-head module according to claim 1, further comprising:

an open bearing disposed on said housing component; and at least two bearing pieces being spaced apart from one another in the X-direction and are configured in each case for self-adjusting positioning in said open bearing.

21. The print-head module according to claim 20, further comprising a catching device for rough positioning in relation to a bearing seat of said bearing pieces being disposed on said housing component.

22. The print-head module according to claim 1, further comprising:

a stop face disposed on said housing component; and a stop piece for coming into contact with said stop face.

23. The print-head module according to claim 1, further comprising at least one of:

at least control boards for said print heads and being mounted on said support frame;

supply lines for an operating medium, electric energy, air and/or coolant being mounted on said support frame;

control lines for information signals being mounted on said support frame;

fuses being mounted on said support frame; or a supply or drive units for said print heads being mounted on said support frame.

24. The single-pass inkjet printer according to claim 23, further comprising a stop face disposed on said frame construction; and wherein said housing component of said at least one print-head module has a stop piece bearing against said stop face.

25. A single-pass inkjet printer, comprising:

a frame construction;

at least one print-head module containing a number of print heads, a swing axis, a housing component having a transverse bracket extending in an X-direction and on said transverse bracket said number of print heads are disposed and are adjusted positionally with respect to at least one reference position, and a support frame having rest devices for resting said support frame, said housing component being mounted on said support frame such that said housing component can swing about said swing axis; and at least one support disposed on said frame construction, said print-head module being deposited by means of said rest devices on said at least one support.

26. The single-pass inkjet printer according to claim 25, wherein said at least one support contains a planar rest face which is supported via a ball joint.

27. The single-pass inkjet printer according to claim 25, further comprising:

open bearings disposed on said frame construction; and at least two bearing pieces, which are spaced apart in the X-direction, of said housing component of said at least one print-head module being positioned in in each case one of said open bearings disposed on said frame construction.

* * * * *